US007168965B2

(12) United States Patent
Akino

(10) Patent No.: US 7,168,965 B2
(45) Date of Patent: Jan. 30, 2007

(54) CONDENSER MICROPHONE

(75) Inventor: Hiroshi Akino, Machida (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 0 days.

(21) Appl. No.: 11/248,237

(22) Filed: Oct. 13, 2005

(65) Prior Publication Data

US 2006/0084298 A1 Apr. 20, 2006

(30) Foreign Application Priority Data

Oct. 20, 2004 (JP) ..... 2004-305617

(51) Int. Cl.
*H01R 13/648* (2006.01)

(52) U.S. Cl. ..... 439/95; 439/349

(58) Field of Classification Search ..... 439/95, 439/91, 96, 14, 97, 349, 578
See application file for complete search history.

(56) References Cited

U.S. PATENT DOCUMENTS 2,869,095 A * 1/1959 Arson ..... 439/354
2,880,403 A * 3/1959 Maxwell ..... 439/101
3,219,961 A * 11/1965 Bailey et al. ..... 439/354
4,120,552 A * 10/1978 Winkler et al. ..... 439/95
4,261,628 A * 4/1981 Gallagher et al. ..... 439/95
4,361,375 A * 11/1982 Bailey et al. ..... 439/357
4,637,669 A * 1/1987 Tajima ..... 439/95
4,738,628 A * 4/1988 Rees ..... 439/95
4,929,188 A * 5/1990 Lionetto et al. ..... 439/349
5,195,904 A * 3/1993 Cyvoct ..... 439/349
5,573,411 A * 11/1996 Bartosz et al. ..... 439/95
5,704,809 A * 1/1998 Davis ..... 439/578
6,716,041 B2 * 4/2004 Ferderer et al. ..... 439/95

* cited by examiner

*Primary Examiner*—Tulsidas C. Patel
*Assistant Examiner*—Vladimir Imas
(74) *Attorney, Agent, or Firm*—Manabu Kanesaka

(57) ABSTRACT

A condenser microphone includes a microphone case formed by a metallic cylindrical body and having a three-pin output connector in a connector housing section, and a connection plug having a balanced shielded cable connected to the three-pin output connector by inserting into the connector housing section. The connection plug is provided with a metallic outer ring electrically connected to a shield coated line of the balanced shielded cable, and contacts the inner surface of the connector housing section. A contactor for grounding is formed of a plate spring material to elastically and electrically contact with the outer ring of the connection plug. The contactor is provided on the inner surface side of the connector housing section. Thus, high frequency impedance in a connecting portion between the microphone case and the connection plug on the output cable side is reduced, by which generation of noise due to electromagnetic waves is prevented.

3 Claims, 1 Drawing Sheet

CONDENSER MICROPHONE

TECHNICAL FIELD

The present invention relates to a condenser microphone and, more particularly, to a shielding technique for a microphone case thereof.

BACKGROUND ART

A condenser microphone includes a microphone unit in which a diaphragm and a backplate are arranged so as to be opposed to each other. The microphone unit incorporates an impedance converter because of its very high impedance. As the impedance converter, a field effect transistor (FET) is usually used, and on rare occasions, a vacuum tube is used.

An electronic circuit for audio output of the condenser microphone is housed in a metallic cylindrical microphone case in a state of being mounted on a substrate. Usually, at one end of the microphone case, a connector housing section is provided, and in the connector housing section, a three-pin type output connector (three-pin output connector) specified in EIAJ RC5236 (Audio latch lock round type connector) is mounted.

When the microphone is used, the output connector is connected to a phantom power source via an output cable (balanced shielded cable) having a connection plug that is the mate to the output connector. The connection plug is provided with three female contacts mating with three pins (grounding, signal hot side, and signal cold side) of the output connector, and also a metallic outer ring connected to a shield coated line is provided. When the output connector is inserted in the connector housing section, the outer ring comes into contact with the inner surface of the connector housing section, and is electrically connected to the microphone case.

If strong electromagnetic waves radiated from a cellular phone or the like are applied to the microphone or the output cable, the electromagnetic waves pass through the output cable and intrude into the microphone via the output connector. In the microphone, the electromagnetic waves are sometimes demodulated by the impedance converter and delivered from the microphone as noise having an audio frequency.

To prevent this phenomenon, No. 1 pin for grounding of the three pins that the output connector has is connected to the microphone case, and the outer ring of the connection plug connected to the shield coated line is brought into contact with the inner surface of the microphone case (inner surface of the connector housing section) to provide electrical connection, by which a shielding function is given to the microphone case.

However, since the connector housing section and the outer ring of connection plug engage with each other in a cylindrical male-and-female engagement manner, the contact is a point contact, and this point contact portion has high frequency impedance, which provides incomplete shield. Also, if looseness due to a dimensional error etc. is present between the connector housing section and the outer ring of connection plug, the contact point is unfixed, and the shield becomes unstable. Such incompleteness and instability of shield bring about the generation of noise due to electromagnetic waves.

SUMMARY OF THE INVENTION

Accordingly, an object of the present invention is to prevent the generation of noise due to electromagnetic waves by reducing high frequency impedance in a connecting portion between a microphone case and an outer ring of a connection plug on the output cable side and hence by giving a stable shielding function to the microphone case, thereby preventing the generation of noise due to electromagnetic waves.

To achieve the above object, the present invention provides a condenser microphone including a microphone case which is formed by a metallic cylindrical body and is provided with a connector housing section on one end side thereof; a three-pin output connector mounted in the connector housing section; and a connection plug which is provided on a balanced shielded cable and is connected to the three-pin output connector in a state of being inserted in the connector housing section, the connection plug being provided with a metallic outer ring which is electrically connected to a shield coated line of the balanced shielded cable and is in contact with an inner surface of the connector housing section and electrically connected to the microphone case, wherein a contactor for grounding which is formed of a plate spring material which is in elastic contact with and electrically connected to the outer ring of the connection plug is provided on the inner surface side of the connector housing section.

According to this configuration, since the contactor for grounding which is formed of a plate spring material which is in elastic contact with and electrically connected to the outer ring of the connection plug is provided on the inner surface side of the connector housing section, the microphone case and the outer ring of connection plug are in contact with each other with a wide area and moreover without looseness. Therefore, the high frequency impedance in the connecting portion is reduced, and the shielding function of microphone case becomes stable, so that the generation of noise due to electromagnetic waves can be prevented effectively.

As a more favorable mode, a plurality of the contactors are arranged at substantially even intervals along the circumferential direction of the inner surface of the connector housing portion.

According to this configuration, the contact area between the microphone case and the outer ring of connection plug increases, and looseness is restrained surely, so that the effect of the above-described invention can further be increased.

DETAILED DESCRIPTION

Figure 1:
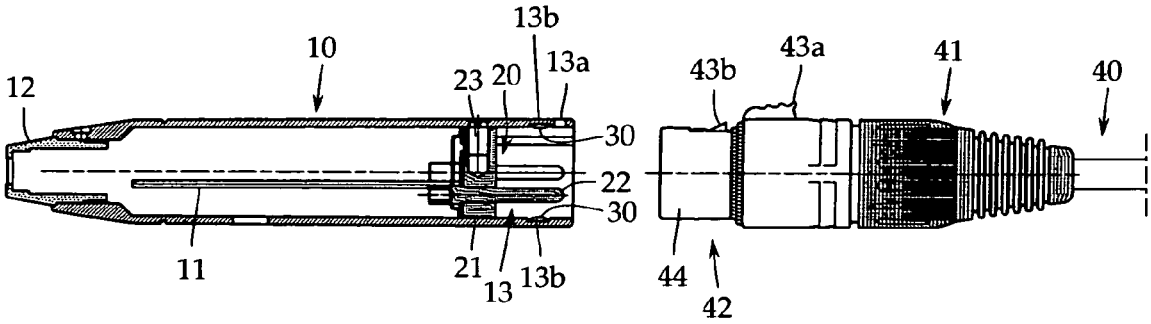
FIG. 1 is a sectional view separately showing a microphone case that a condenser microphone in accordance with the present invention has and a connection plug on the output cable side.
Figure 2:
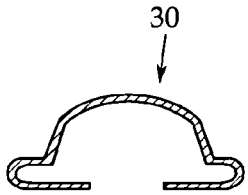
FIG. 2 is a sectional view showing one example of a contactor provided in the microphone case.
Figure 3:
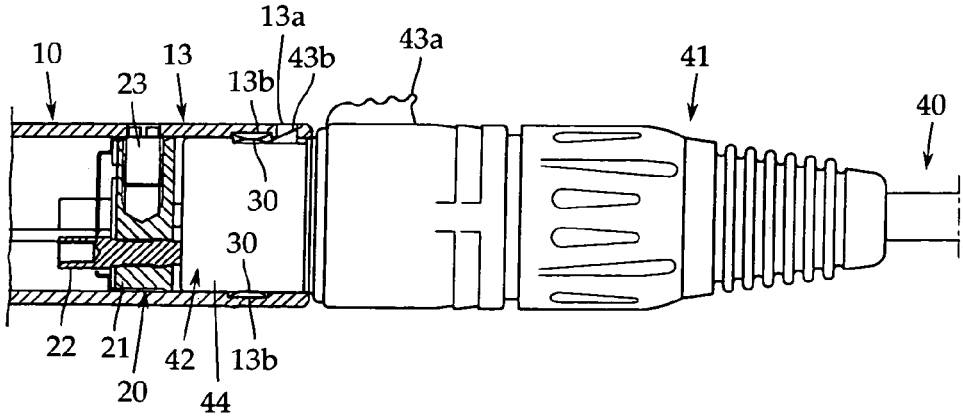
FIG. 3 is an enlarged sectional view showing a connection state between the microphone case and the connection plug.

An embodiment of the present invention will now be described with reference to FIGS. 1 to 3. The present invention is not limited to this embodiment. FIG. 1 is a sectional view separately showing a microphone case that a condenser microphone in accordance with the present invention has and a connection plug on the output cable side. FIG. 2 is a sectional view showing a contactor provided in the microphone case. FIG. 3 is an enlarged sectional view showing a connection state between the microphone case and the connection plug.

A microphone case 10 shown in FIG. 1 is, as in the case of a gooseneck microphone or a tie clip microphone, a microphone case used for an audio output module section of a separate condenser microphone in which a condenser microphone unit and the audio output module section are connected to each other via a microphone cable.

The illustration of the condenser microphone unit is omitted because the condenser microphone unit may be a publicly known one. Also, the audio output module section is also called a power module section because it is provided with a polarization power supply circuit for the condenser microphone unit.

The microphone case 10 consists of a cylindrical body formed by casting (die casting) of zinc, aluminum, or the like, and a substrate 11 mounted with an audio output circuit, the polarization power supply circuit, and the like is housed in the microphone case 10. To the substrate 11, a microphone cable, not shown, led into the microphone case 10 is soldered, and to one end side of the microphone case 10, a cord bush 12 for the microphone cable is attached.

The other end side of the microphone case 10 forms a connector housing section 13, and therein is mounted an output connector 20. As the output connector 20, a three-pin type output connector specified in EIAJ RC5236 (Audio latch lock round type connector) is used.

The output connector 20 includes three pins of No. 1 pin for grounding provided penetratingly in a synthetic resin made seating 21, No. 2 pin on the signal hot side, and No 3 pin on the signal cold side. Since FIG. 1 is a sectional view, only two pins of the three pins are shown. A pin shown in section is the No. 1 pin 22 for grounding, and the No. 1 pin 22 is allowed to conduct to the microphone case 10 via a metal conductor plate, not shown. The output connector 20 is firmly fixed into the connector housing section 13 with a fixing screw 23 provided in the seating 21.

When this condenser microphone is used, the output connector 20 is connected to a phantom power source, not shown, via an output cable 40 consisting of a balanced shielded cable. For this purpose, the output cable 40 is provided with a connection plug 41 that is detachable from the output connector 20.

The connection plug 41 has a cylindrical portion 42 that is inserted in the connector housing section 13. Although not shown, three female contacts mating with the three pins of the output connector 20 are arranged in the cylindrical portion 42. Also, in an outer peripheral portion of the cylindrical portion 42, a metallic outer ring 44 electrically connected to a shield coated line, not shown, of the output cable is provided.

Also, since the connection plug 41 is of a latch lock type, the connection plug 41 is provided with a locking claw 43*b* operated by a knob 43*a*, and on the connector housing section 13 side, a locking hole 13*a*, which is the mate to the locking claw 43*a*, is formed. The locking claw 43*b* is normally urged in the projecting direction by a spring means, not shown. By inserting the cylindrical portion 42 into the connector housing section 13, the locking claw 43*a* is automatically locked in the locking hole 13*a*, and by pressing the knob 43*a*, the locking claw 43*a* is unlocked.

As described above, by inserting the cylindrical portion 42 of the connection plug 41 into the connector housing section 13, the three pins and the three female contacts are connected to each other, and the outer ring 44 comes into contact with the inner surface of the connector housing section 13, by which a shielding function is given to the microphone case 10. In the present invention, since the high frequency impedance in the contact portion decreases, a contactor 30 is provided on the inner surface of the connector housing section 13.

This contactor 30 is formed of a plate spring material which is in elastic contact with and electrically connected to the outer ring 44. One example of the shape of the contactor 30 is shown in FIG. 2. Also, the contact state between the contactor 30 and the outer ring 44 is shown in FIG. 3. In this example, the contactor 30 is formed into a chevron shape. If the vertex portion of the chevron shape is pressed by the outer ring 44, the foot portions thereof are crushed so as to spread, and if the outer ring 40 is removed, the chevron shape is restored to the original shape. The shape of the contactor 30 may be selected arbitrarily as far as it can be brought into elastic contact with the outer ring 44.

In providing the contactor 30 on the inner surface of the connector housing section 13, it is preferable that a clearance between the inner surface of the connector housing section 13 and the outer ring 44 be slight, and in order to prevent a positional shift of the contactor 30, it is preferable that as shown in FIG. 3, a housing groove 13*b* with a predetermined depth be formed in the inner surface of the connector housing section 13 to dispose the contactor 30 therein.

The method for fixing the contactor 30 to the connector housing section 13 may be selected appropriately. Any method such as soldering, welding, using of adhesive, or screwing may be used depending on the material of the contactor 30. In the example shown in FIG. 2, the fixing portion of the contactor 30 is preferably one portion of the foot portion on one side to allow deformation when the contactor 30 is pressed by the outer ring 44. In any case, the contactor 30 is fixed in a state of being electrically connected to the connector housing section 13.

Also, in order to greatly reduce the high frequency impedance in the contact portion and to surely restrain looseness, a plurality of contactors 30 are preferably arranged at substantially even intervals along the circumferential direction of the inner surface of the connector housing portion 13.

The present invention has been explained above by taking a separate condenser microphone in which a condenser microphone unit and an output module section are connected to each other by a microphone cord as an example. However, the present invention embraces a condenser microphone having a microphone case provided with a three-pin output connector connected to an output cable (balanced shielded cable) side, for example, a hand-held integral microphone having a microphone case used as a microphone grip.

The present application is based on, and claims priority from, Japanese Application Serial Number JP2004-305617, filed Oct. 20, 2004, the disclosure of which is hereby incorporated by reference herein in its entirety.

The invention claimed is:

1. A condenser microphone comprising:

a microphone case which is formed by a metallic cylindrical body and is provided with a connector housing section on one end side thereof;

a three-pin output connector mounted in the connector housing section;

a connection plug which is provided on a balanced shielded cable and is connected to the three-pin output connector in a state of being inserted in the connector housing section, the connection plug being provided with a metallic outer ring which is electrically connected to a shield coated line of the balanced shielded cable and is in contact with an inner surface of the connector housing section and electrically connected to the microphone case, wherein said connector housing section includes a groove on the inner surface thereof, and a contactor for grounding which is formed of a plate spring material which is in elastic contact with and electrically connected to the outer ring of the connection plug is provided in the groove, wherein a plurality of the contactors are arranged at substantially even intervals along a circumferential direction of the inner surface of the connector housing portion.

2. A condenser microphone comprising:

a microphone case formed by a metallic cylindrical body and having a connector housing section on one end side thereof, an output connector mounted in the connector housing section, a connection plug inserted into the connector housing section to be connected to the output connector, said connection plug having a metallic outer ring to contact an inner surface of the connector housing section to be electrically connected to the microphone case, and a contactor for grounding, formed of a plate spring material and situated inside the connector housing section, said contactor having a vertex portion to contact the outer ring and a foot portion formed at a bottom of the vertex portion and directly attached to the connector housing section, said contactor having resiliency between the vertex portion and the foot portion to resiliently hold the metallic outer ring thereat and to directly connect the connector housing section and the metallic outer ring, wherein said connector housing section includes a groove on the inner surface thereof, in which said contactor is disposed so that the vertex portion projects from the groove.

3. A condenser microphone according to claim 2, wherein said contactor includes one vertex portion and two foot portions to have a chevron shape in section.

* * * * *